US005172775A

United States Patent [19]

Sheirer et al.

[11] Patent Number: 5,172,775

[45] Date of Patent: Dec. 22, 1992

[54] ROTARY DRILL BIT INSERT

[75] Inventors: Daniel C. Sheirer; Gerald L. Woods, both of Bedford, Pa.; Robert H. Montgomery, Jr., Everett, Pa.

[73] Assignee: Kennametal Inc., Latrobe, Pa.

[21] Appl. No.: 665,400

[22] Filed: Mar. 6, 1991

[51] Int. Cl.[5] ..... E21B 7/00

[52] U.S. Cl. ..... 175/57; 175/420.1; 175/426

[58] Field of Search ..... 175/420.1, 421, 426; 408/233, 713, 227

[56] References Cited

U.S. PATENT DOCUMENTS

| | | | |
|---|---|---|---|
| 3,163,246 | 12/1964 | Vagins et al. | 175/420.1 |
| 3,966,350 | 6/1976 | Benjamin | 408/233 |
| 4,342,368 | 8/1982 | Denman | 175/410 |
| 4,489,796 | 12/1984 | Sanchez et al. | 175/410 |
| 4,492,278 | 1/1985 | Leighton | 175/420.1 |
| 4,527,638 | 7/1985 | Sanchez et al. | 175/57 |
| 4,527,931 | 7/1985 | Sarin | 175/383 X |
| 4,568,227 | 2/1986 | Hogg | 408/227 X |
| 4,595,322 | 6/1986 | Clement | 175/415 X |
| 4,696,355 | 9/1987 | Haussmann | 175/395 |
| 4,787,464 | 11/1988 | Ojanen | 175/57 |
| 4,984,944 | 1/1991 | Pennington et al. | 408/227 X |

FOREIGN PATENT DOCUMENTS

| | | | |
|---|---|---|---|
| 148098 | 7/1950 | Australia . | |
| 150758 | 9/1950 | Australia . | |
| 202271 | 1/1956 | Australia . | |
| 25046 | 5/1989 | Australia . | |
| 0187971 | 7/1986 | European Pat. Off. . | |
| 3823409 | 1/1990 | Fed. Rep. of Germany | 408/227 |
| 48102 | 2/1981 | Japan | 408/233 |
| 0842133 | 7/1960 | United Kingdom . | |
| 0908839 | 10/1962 | United Kingdom . | |
| 1062140 | 3/1967 | United Kingdom . | |
| 1338586 | 11/1973 | United Kingdom . | |
| 1569067 | 6/1980 | United Kingdom . | |
| 8502442 | 6/1985 | World Int. Prop. O. . | |

*Primary Examiner*—Ramon S. Britts
*Assistant Examiner*—Roger J. Schoeppel
*Attorney, Agent, or Firm*—John J. Prizzi; Larry R. Meenan

[57] ABSTRACT

A rotary drill bit insert including an elongated body rotatable about a central axis and having two halves symmetrical about the axis, each symmetrical half having a top surface including a planar front surface contiguous a noncoplanar back relief surface, a bottom surface opposite the top surface, a leading face extending between forwardly facing edges of the front surface and the bottom surface, a trailing face opposite the leading face extending between rearwardly facing edges of the back relief surface and the bottom surface and a distal end surface extending between outwardly distal edges of the top surface, leading face, trailing face, and bottom surface.

20 Claims, 4 Drawing Sheets

ROTARY DRILL BIT INSERT

BACKGROUND OF THE INVENTION

1. Field of the Invention

The present invention relates to rotary drill bits including hard wear resistant inserts. More particularly, the present invention relates to the geometry of inserts finding application in rotary drill bits and a method of use.

2. Description of the Related Art

Rotary drill bits are typically attached to a working end of an elongated, hollow drill rod having an opposing end connected to a source of rotary and thrust power. By the action of the source of rotary and thrust power, rotary drill bits may be used for drilling holes in a work surface such as a rock strata in the roof of a mine entry for installing roof bolts or receiving explosive charges. Rotary drill bits which are secured to the working end of the drill rod include a body having a top working surface to which is attached at least one insert made of a hard wear resistant material.

It will be appreciated that the speed with which holes can be drilled, the maintenance of the penetration rate, and the wear and fracture resistance of the inserts used in rotary drill bits are important factors in drilling a work surface. Furthermore, the inserts which may be used in the rotary drill bits must be capable of resisting wear, fracture, and the abrasive action of the chips from the work surface being drilled. Improvements in any of these factors is desirable, and has to some degree been achieved by changing the composition of the insert material, usually a cemented carbide, by adjusting the carbide grain size, or by changing the insert geometry.

The present invention relates to improved insert geometries finding application in rotary drill bits and a method of use of the rotary drill bits.

Examples of various insert geometries may be found in U.S. Pat. Nos. 4,489,796; 4,527,638; 4,342,368; and 4,787,464. Although, the variations in insert geometries heretofore known have improved some or all of the above factors, it will be appreciated that there is still a significant need for improved insert geometries.

SUMMARY OF THE INVENTION

Briefly, according to this invention, there is provided a rotary drill bit including an insert having an elongated body rotatable about a central axis and having two halves symmetrical about the axis. Each half of the drill bit insert includes a leading face, an opposing trailing face, a distal end surface, a top surface, and an opposing bottom surface. The top surface includes a planar front surface contiguous a noncoplanar back relief surface extending between the leading face, trailing face and distal end surface. The intersection of the front surface and the leading face, the front surface and the back relief surface, define a cutting edge and a clearance edge, respectively.

In one embodiment of the present invention, the relief edge formed by the intersection of the back relief surface and the front planar surface extends diagonally from the cutting edge of the insert to an outside trailing edge between a leading face and a trailing face.

In yet another embodiment of the present invention, the clearance edge extends diagonally from the cutting edge to a corner formed by the intersection of the radial distal edge and the trailing face.

The back relief surface may be either a planar surface or concave or rounded to provide additional clearance for the top surface as the insert drills a work surface.

In accordance with another aspect of the present invention, a new and improved method of drilling a hole in a work surface is provided. The new and improved method comprises positioning a drill bit including an insert according to the present invention, rotating the drill bit from about 200 to about 1,000 rpm, applying a thrust to the drill bit from about 1,000 to about 10,000 lbs. and drilling a hole in a work surface.

BRIEF DESCRIPTION OF THE DRAWINGS

Further features and other aspects of this invention will become clear from the following detailed description made with reference to the drawings in which.

DESCRIPTION OF THE PREFERRED EMBODIMENTS

Figure 1:
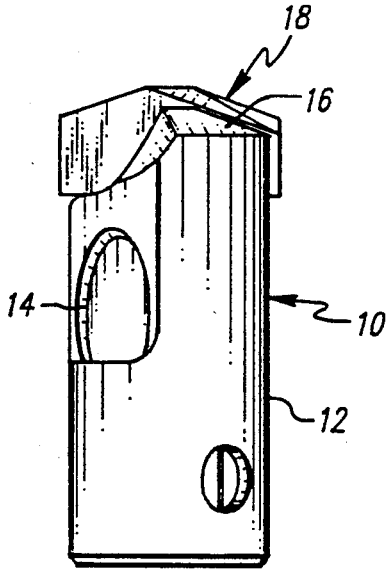
FIG. 1 is a perspective view of a rotary drill bit including an insert in accordance with the present invention.

In the following description, like reference characters designate like or corresponding parts. Also, in the following description, it is to be understood that such terms as "front," "back," "top," "bottom," "outer," "forwardly," "rearwardly," and the like, are words of convenience and are not to be construed as limiting terms.

It will be readily apparent to those skilled in the art that the present invention may be used with equal facility in various size rotary drill bit inserts and perform equally as well.

Referring now to FIG. 1, there is shown a rotary drill bit 10. The rotary drill bit 10 includes a cylindrical body 12 having two opposing dust collection openings 14 and a top working surface 16 to which is attached an insert 18 made of a hard wear resistant material. The insert 18 of the rotary drill bit 10 includes a generally flat elongated body having two halves 20 and 21 (FIG. 2) symmetrical and rotatable about a central axis 22. Each half of the body of the insert 18 includes a top surface 24, a bottom surface 26, a leading face 28, a trailing face 30 and a distal end surface 32.

The top surface 24 of each half 20 and 21 of the insert 18 intersect to define a medial edge 34 and each top surface of each half intersect a corresponding leading face 28 and trailing face 30 to define a front cutting edge 36 and a trailing edge 38, respectively. Similarly, a distal outer edge 40 is formed by the intersection of the distal end surface 32 and the top surface 24, bottom surface 26, leading face 28 and trailing face 30.

The leading face 28 of each symmetrical half 20 and 21 of the insert 18 is generally a planar surface extending between the forwardly facing edges of the top surface 24 and the bottom surface 26. As shown in FIGS. 4, 7-10, 12, 14-17, 20 and 25, the leading face 28 is inclined at a constant angle with respect to a plane containing the central axis 22. This constant angle of inclination of the leading face 28 is preferably 0 degrees, however, the angle of inclination may range from 0-3 degrees such as that shown in U.S. Pat. No. 4,787,464 resulting in an insert 18 thickness at bottom surface 26 less than or equal to the insert thickness at top surface 24. In an alternative embodiment, the leading face 28 may also be inclined at a variable angle with respect to the plane containing the central axis 22 such as shown in U.S. Pat. No. 4,342,368.

Positioned opposite the leading face 28 of each half 20 and 21 of the insert 18 is a generally planar trailing face 30. The trailing face 30 extends inwardly from the distal end surface 32 between the rearwardly facing edges of the top surface 24 and the bottom surface 26. Each trailing face 30, and optionally part or all of the leading face 28 may meet bottom surface 26 at a beveled, radiused or rabbeted edge. These shaped edges may be provided to aid conformation of the insert 18 within a slot formed within the drill bit 10.

Figure 2:
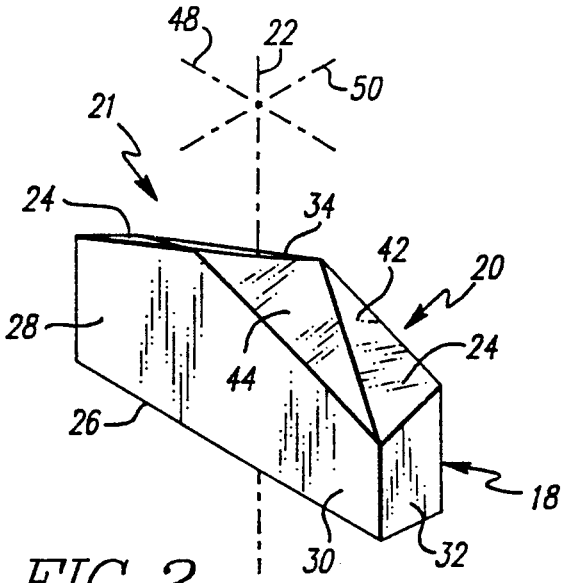
FIG. 2 is a perspective view of an insert in accordance with the present invention.
Figure 11:
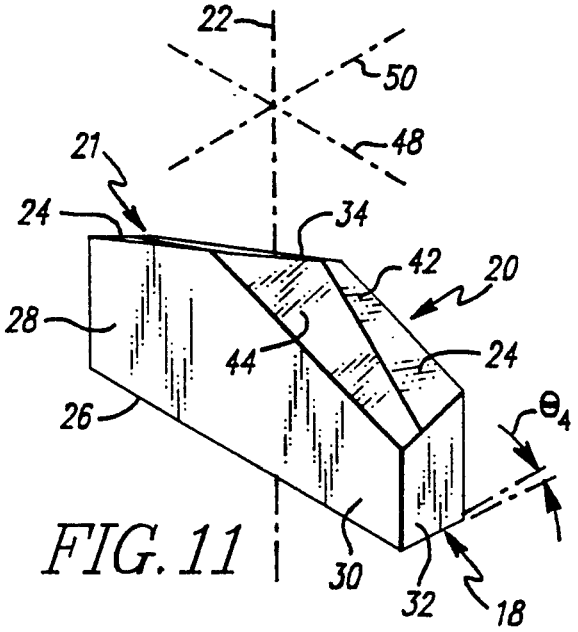
FIG. 11 is a perspective view of an insert produced in accordance with the present invention.
Figure 12:
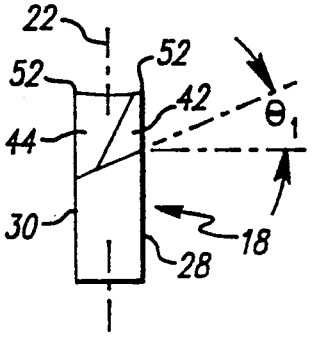
FIG. 12 is a side view of FIG. 11.
Figure 18:
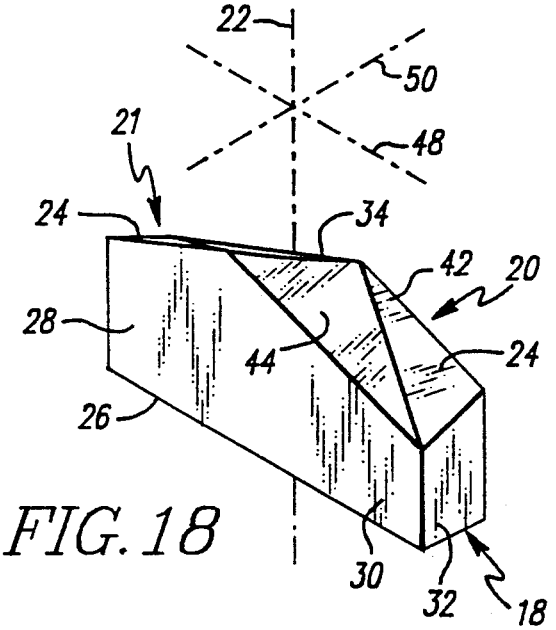
FIG. 18 is a perspective view of an insert produced in accordance with the present invention.
Figure 22:
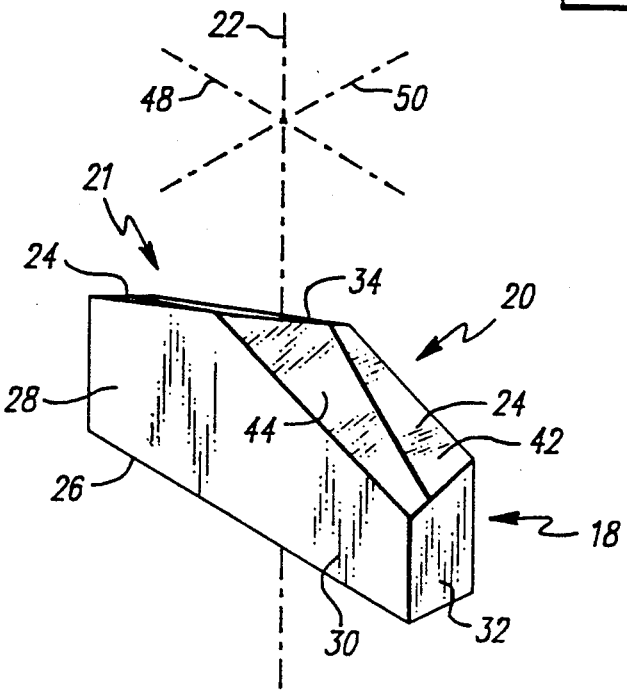
FIG. 22 is a perspective view of an insert produced in accordance with the present invention.
Figure 25:
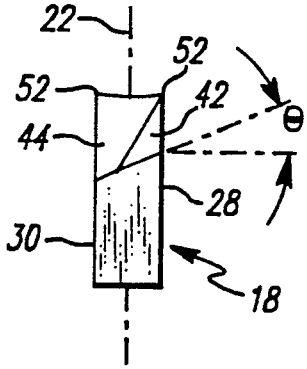
FIG. 25 is a side view of FIG. 22.

The top surface 24 of the insert 18 of the present invention is formed of a front surface 42 contiguous a noncoplanar back relief surface 44. The front surface 42 is typically polygonal in shape and extends rearwardly from the front cutting edge 36 to a clearance edge 46 formed by the intersection of the front surface 42 and back relief surface 44 between the medial edge 34 and the distal outer edge 40. As shown in FIGS. 2, 18 and 22 the front surface 42 is triangular shaped and as shown in FIG. 11 the front surface is trapezium shaped.

Figure 24:
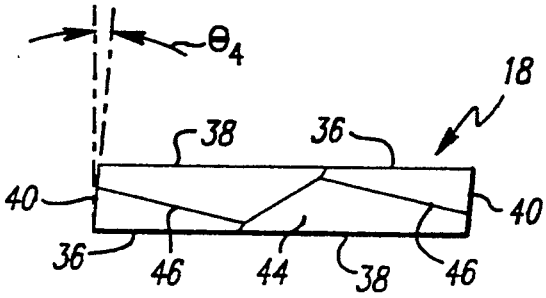
FIG. 24 is a top view of FIG. 22.

The clearance edge 46 as defined by the intersection of the front surface 42 and back relief surface 44 extends radially from approximately a central portion of the insert 18 to the distal outer edge 40 between the trailing edge 38 and the cutting edge 36. In one embodiment of the present invention the clearance edge 46 may extend from approximately a central portion of the insert 18 to a distal outer edge corner formed by the intersection of the trailing face 30, top surface 24 and distal end surface 32 (FIGS. 2, 5, 18 and 21). In yet another embodiment of the present invention the clearance edge 46 may extend from approximately a central portion of the insert 18 to a distal outer edge 40 intermediate the cutting edge 36 and the trailing edge 38 (FIGS. 11, 22 and 24).

The relief angle of the front surface 42 is inclined at a constant angle of inclination $\theta_1$ with respect to a first radial line 48 projecting from the central axis 22 and at a constant angle of inclination $\theta_2$ with respect to a second line 50 normal to the radial line 48. The relief angle $\theta_1$ of the front surface 42 with respect to the second line 50 at all points along the cutting edge is between about 10-40 degrees, preferably 20-35 degrees and most preferably 24 degrees. The constant relief angle $\theta_2$ of inclination of the front surface 42 with respect to the first radial line 48 is approximately 18-22 degrees, and more preferably 20 degrees. It will be appreciated that the relief angle of the front surface 42 may also be varied such as that shown in U.S. Pat. No. 4,787,464.

The back relief surface 44 is also polygonal in shape and extends forwardly from the trailing edge 38 to the clearance edge 46 between the medial edge 34 and the distal outer edge 40. As shown in FIGS. 2, 5, 18 and 21 the back relief surface 44 is triangular shaped and as shown in FIGS. 11, 22 and 24 the back relief surface is trapezium shaped. As shown in FIGS. 2, 3, 7-10, 11, 12, 13-17 and 25, the back relief surface 44 along the radial length thereof may be rounded or radiused from the clearance edge 46 to the trailing edge 38 to form a concave back relief surface 44. In yet another embodiment of the present invention the back relief surface 44 may be planar, FIGS. 18-21. The plane formed between the clearance edge 46, trailing edge 38 and those portions of the distal outer edge 40 and medial edge 34 bordering the back relief surface 44 is inclined at an angle $\theta_3$ with respect to the second line 50 which is at least equal to or steeper than the corresponding angle of inclination of the front surface 42. As shown in FIGS. 3, 7-10 and FIGS. 13, 14-17, the angle $\theta_3$ of inclination of the plane formed by the clearance edge 46, trailing edge 38 and those portions of the distal outer edge 40 and medial edge 34 bordering the rounded back relief surface 44 varies with radial distance from the central portion of the insert 18. In one embodiment of the present invention as shown in FIGS. 3, 4, 7-10, the rounded back relief surface 44 angle of inclination $\theta_3$ increases from approximately 23 degrees (FIG. 7) to approximately 28 degrees (FIG. 8) to approximately 30 degrees (FIG. 9) and then decreases to approximately 24 degrees (FIG. 10) at the distal outer edge 40. It will be appreciated that various other arrangements for the angle of inclination $\theta_3$ of the back relief surface 44 to suit a particular application are possible by merely changing the radius, $R_1$, of the circular back relief surface 44 and/or changing the position of the clearance edge 46. For example, as shown in FIGS. 13-17, the rounded back relief surface 44 angle of inclination $\theta_3$ continually increases from approximately 25 degrees (FIG. 14) to approximately 28 degrees (FIG. 15) to approximately 29 degrees (FIG. 16) to approximately 30 degrees at the distal outer edge 40 (FIG. 17) by changing the position of the clearance edge 46 and/or increasing the radius, $R_1$, of the circular back relief surface. In a preferred embodiment, the radius $R_1$ of the back relief surface is approximately 1 inch, however, the radius $R_1$ of the back relief surface 44 may range from ½ inch or more depending upon the type of work surface to be drilled.

Figure 3:
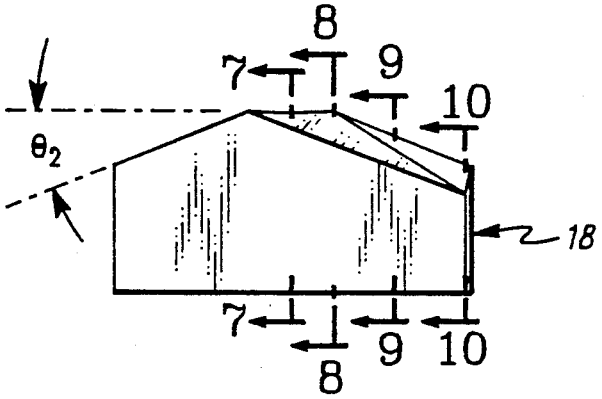
FIG. 3 is a front view of the insert of FIG. 2.
Figure 4:
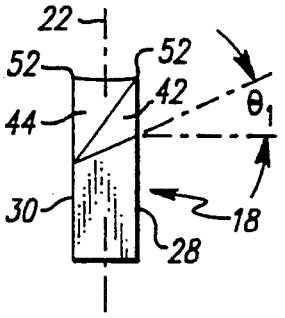
FIG. 4 is a side view of the insert of FIG. 2.
Figure 5:
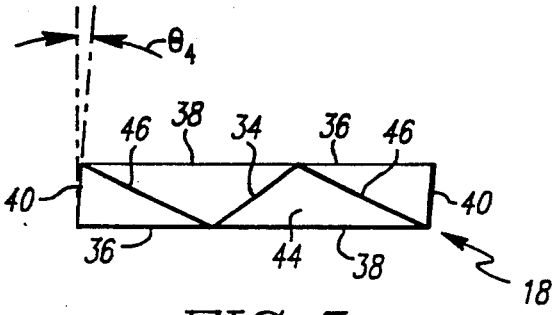
FIG. 5 is a top view of the insert of FIG. 2.
Figure 13:
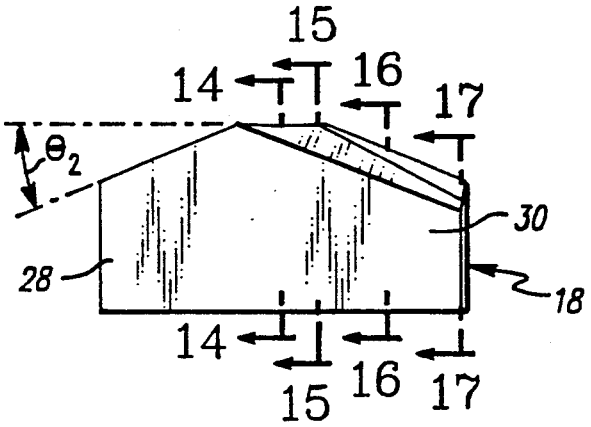
FIG. 13 is a front view of FIG. 11.
Figure 14:
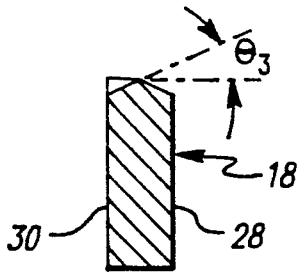
FIG. 14 is a cross-sectional view of the insert of FIG. 13 taken along line 14—14.
Figure 15:
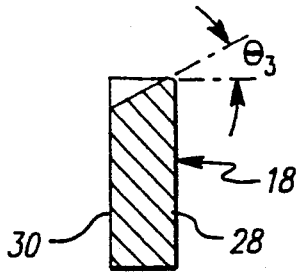
FIG. 15 is a cross-sectional view of the insert of FIG. 13 taken along line 15—15.
Figure 16:
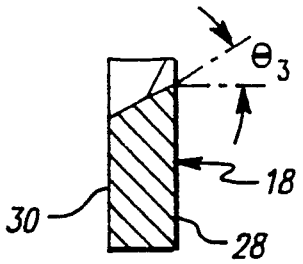
FIG. 16 is a cross-sectional view of the insert of FIG. 13 taken along line 16—16.
Figure 17:
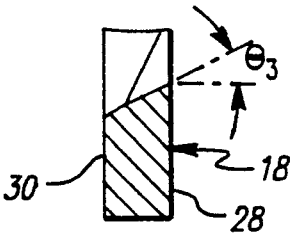
FIG. 17 is a cross-sectional view of the insert of FIG. 13 taken along line 17—17.
Figure 19:
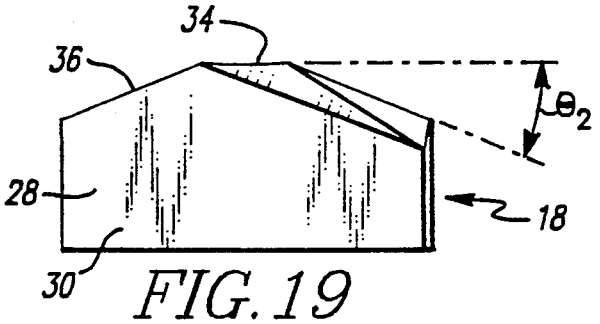
FIG. 19 is a front view of FIG. 18.
Figure 20:
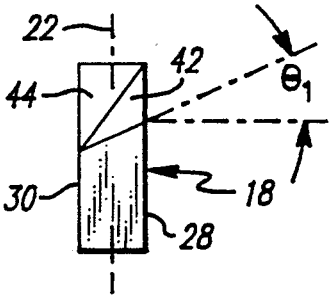
FIG. 20 is a side view of FIG. 18.
Figure 21:
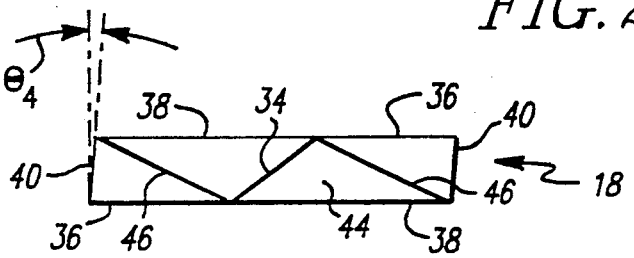
FIG. 21 is a top view of FIG. 18.
Figure 23:
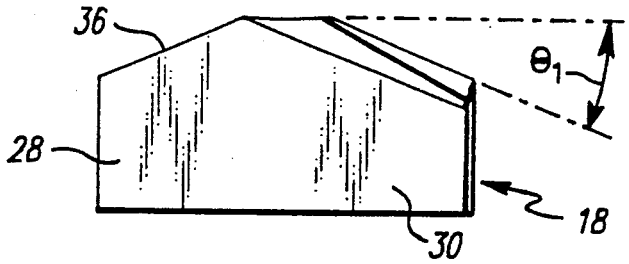
FIG. 23 is a front view of FIG. 22.

It will be appreciated that as result of a rounded back relief surface 44 the medial edge 34 formed by the adjoining rounded back relief surfaces 44 of each half 20 and 21 of the insert 18 is also concave, FIGS. 3, 13 and 19. The concave medial edge 34 provides a penetration tip 52 at the intersection of the medial edge and cutting edge 36 of each half 20 and 21 of the insert 18 to assist in the alignment of the insert and penetration of the insert into a work surface during the initial stages of the drilling operation.

Figure 6:
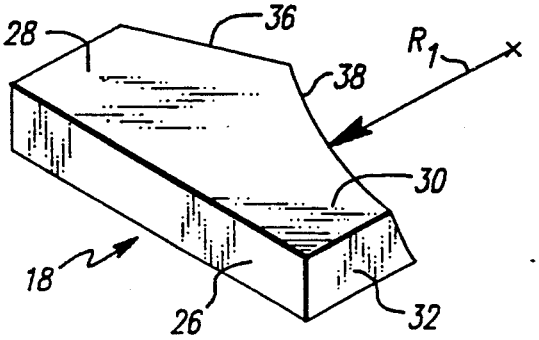
FIG. 6 is a perspective view of the insert shown in FIGS. 2, 11 and 22 rotated 90 degrees illustrating a rounded back relief surface.
Figure 7:
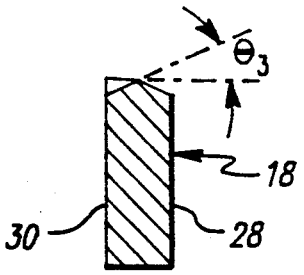
FIG. 7 is a cross-sectional view of the insert of FIG. 3 taken along line 7—7.
Figure 8:
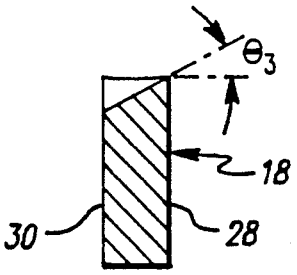
FIG. 8 is a cross-sectional view of the insert of FIG. 3 taken along line 8—8.
Figure 9:
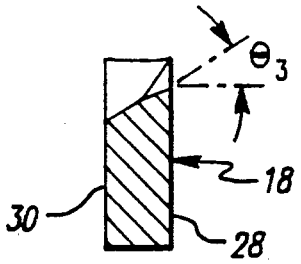
FIG. 9 is a cross-sectional view of the insert of FIG. 3 taken along line 9—9.
Figure 10:
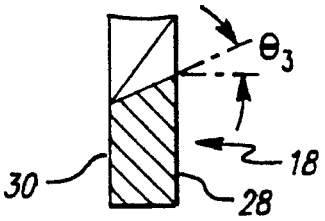
FIG. 10 is a cross-sectional view of the insert of FIG. 3 taken along line 10—10.

The bottom surface 26 of the insert 18, FIG. 6, is generally of a planar rectangular shape. However, the bottom surface 26 may be of most any suitable shape and contour to provide a suitable surface for brazing of the insert 18 within a slot formed within the rotating drill bit 10 as is well known in the art.

Extending between the distal outer edges 40 of the top surface 24, bottom surface 26, trailing face 30 and leading face 28 is the distal end surface 32. The end surface 32 is inclined rearwardly and inwardly toward the trailing face 30 thereby providing a relief angle $\theta_4$ for the end surface. As shown in FIGS. 5, 11, 21 and 24, the relief angle $\theta_4$ is preferably about 3–7 degrees with respect to a plane parallel to the central axis 22 and normal to the leading face 28. As previously described, the distal end surface 32 of each half of the insert 18 may also be tapered thereby narrowing the insert at the bottom surface 26. Preferably, the tapered relief angle of the end surface 32 is approximately 0–2 degrees with respect to a line parallel to the central axis 22.

Each distal end surface 32 intersects a leading face 28 to define a leading distal outer edge. The leading distal outer edge may be rounded or radiused as described in U.S. Pat. No. 4,489,796. A corner point, defined by the intersection of the leading edge and the cutting edge 36, is located a maximum distance from the central axis 22.

The insert 18 in accordance with the present invention may be comprised of a composite material, the components of which may be uniformly distributed throughout the insert or alternatively, the ratio of the components may vary from one region to another within the insert, such as from the insert surface to the insert core. A preferred material for the insert 18 is a cemented tungsten carbide containing about 5–15 wt. % cobalt as a binder, optionally with other refractory materials, such as cubic refractory transition metal carbides, as additives. The grain size of the tungsten carbide may vary from fine (e.g. about 1 micron), providing a harder insert, to coarse (e.g. about 12 micron), providing a tougher insert, depending on the intended use, the carbide to binder ratio, and the degree of fracture toughness desired. The inserts 18 according to the invention may be utilized in various mine tool equipment according to the methods commonly accepted in the arts. Normally, the drill bit 10 containing the insert 18 will be fastened to a standard drill rod, which will be positioned to drill a hole in a work surface, and the bit will be rotated at about 250–600 rpm and about 1000–10,000 lbs. thrust for a time sufficient to drill the desired hole in the work surface.

The invention will be further clarified by a consideration of the following examples, which are intended to be purely exemplary of the use of the invention. In each example, the inserts tested were of identical WC-Co composition identifiable as Grade 12 and available from Kennametal Inc. and brazed to a KCV4 bit body also available from Kennametal Inc.

EXAMPLE 1

A one inch insert according to FIGS. 11–17 in a KCV4 bit body was tested in a laminated sandstone and shale work surface under actual field conditions. Approximately 11 holes approximately 48 inches deep were drilled in the work surface at 580 rpm, 2,000 lbs. thrust using the insert in accordance with the present invention. The average penetration rate for the insert in accordance with the present invention was approximately 10 feet/minute.

EXAMPLE 2

A commercially available standard one inch mine tool KCV1 insert available from Kennametal Inc. in a KCV4 bit body was tested in a laminated sandstone and shale work surface under actual field conditions. Approximately 4 holes approximately 48 inches deep were drilled in the work surface at 580 rpm, 2,000 lbs. thrust. The average penetration rate for the standard one inch mine tool insert KCV1 was approximately 6.5 feet/minute.

EXAMPLE 3

A one inch insert according to FIGS. 11–17 in a KCV4 bit body was tested in a laminated sandstone and shale work surface under actual field conditions. Approximately 26 holes approximately 48 inches deep were drilled in the work surface at 580 rpm, 3,000 lbs. thrust using the insert in accordance with the present invention. The average penetration rate for the insert in accordance with the present invention was approximately 12.5 feet/minute.

EXAMPLE 4

A commercially available standard one inch mine tool KCV1 insert available from Kennametal Inc. in a KCV4 bit body was tested in a laminated sandstone and shale work surface under actual field conditions. Approximately 9 holes approximately 48 inches deep were drilled in the work surface at 580 rpm, 3,000 lbs. thrust. The average penetration rate for the standard one inch mine tool insert KCV1 was approximately 10.5 feet/minute.

EXAMPLE 5

A one inch insert according to FIGS. 18–21 in a KCV4 bit body was tested in a laminated soft shale work surface under actual field conditions. Approximately 8 holes approximately 42 inches deep were drilled in the work surface at 460 rpm, 5,000 lbs. thrust using the insert in accordance with the present invention. The average penetration rate for the insert in accordance with the present invention was approximately 11 feet/minute.

EXAMPLE 6

A commercially available standard one inch mine tool KCV1 insert available from Kennametal Inc. in a KCV4 bit body was tested in a laminated soft shale work surface under actual field conditions. Approximately 5 holes approximately 42 inches deep were drilled in the work surface at 460 rpm, 5,000 lbs. thrust. The average penetration rate for the standard one inch mine tool insert KCV1 was approximately 11 feet/minute.

EXAMPLE 7

A one inch insert according to FIGS. 18–21 in a KCV4 bit body was tested in a laminated sandstone and shale work surface under actual field conditions. Approximately 4 holes approximately 72 inches deep were drilled in the work surface at 460 rpm, 5,000 lbs. thrust using the insert in accordance with the present invention. The average penetration rate for the insert in accordance with the present invention was approximately 2.2 inches/second.

EXAMPLE 8

A commercially available standard one inch mine tool KCV1 insert available from Kennametal Inc. in a KCV4 bit body was tested in a laminated sandstone and shale work surface under actual field conditions. Approximately 3 holes approximately 72 inches deep were drilled in the work surface at 460 rpm, 5,000 lbs. thrust. The average penetration rate for the standard one inch mine tool insert KCV1 was approximately 10.5 feet/minute.

In view of the foregoing, it is believed that the design of an insert in drilling a soft shale work surface is less a factor than the magnitude of the lbs. thrust of the drill bit in drilling the soft shale work surface. However, as illustrated by Examples 1–4, 7 and 8, the mine tool roof bits and inserts according to the present invention generally provide improved wear resistance, longer tool life, and faster penetration rates during the drilling of holes in mine roofs.

The patents referred to herein are hereby incorporated by reference.

Having described presently preferred embodiments of the present invention, it is understood that the invention may be otherwise embodied within the scope of the following claims.

What is claimed is:

1. A rotary drill bit insert (18) comprising an elongated body rotatable about a central axis (22) and having two halves (20, 21) symmetrical about the axis (22), each symmetrical half having a top surface (24) including a planar front surface (42) contiguous and noncoplanar with a back relief surface (44), a bottom surface (26) opposite said top surface (24), a leading face (28) extending between forwardly facing edges of said front surface (42) and of said bottom surface (26), a trailing face (30) opposite said leading face (28) extending between rearwardly facing edges of said back relief surface (44) and of said bottom surface (26) and a distal end surface (32) extending between outwardly distal edges of said top surface (24), leading face (28), trailing face (30), and bottom surface (26), said front surface (42) inclined with radial distance at a constant angle of inclination with respect to a first radial line (48) projecting from said central axis (22) and inclined downwardly and rearwardly from said forwardly facing edge of said front surface (42) and inclined at a constant angle of inclination with respect to a second line (50) normal to said radial line (48) and to said central axis (22).

2. The rotary drill bit insert as set forth in claim 1 wherein said front surface is inclined with radial distance from said central axis at a constant angle of inclination with respect to a first radial line projecting from said central axis and inclined at a constant angle of inclination with respect to a second line normal to said radial line.

3. The rotary drill bit insert as set forth in claim 1 wherein said back relief surface is inclined with radial distance from said central axis at a variable angle of inclination with respect to said second line.

4. The rotary drill bit insert as set forth in claim 1 wherein said front surface is triangular shaped.

5. The rotary drill bit insert as set forth in claim 1 wherein said front surface is trapezium shaped.

6. The rotary drill bit insert as set forth in claim 1 wherein said angle of inclination of said front surface with respect to said second line is between about 15 to 55 degrees.

7. The rotary drill bit insert as set forth in claim 1 wherein said angle of inclination of said front surface with respect to said second line is approximately 22 degrees.

8. The rotary drill bit insert as set forth in claim 3 wherein said back relief surface is triangular shaped.

9. The rotary drill bit insert as set forth in claim 3 wherein said back relief surface is trapezium shaped.

10. The rotary drill bit insert as set forth in claim 3 wherein said top surfaces of each symmetrical half intersect to define a medial edge.

11. The rotary drill bit insert as set forth in claim 10 wherein said medial edge is concave or linear.

12. The rotary drill bit insert as set forth in claim 10 wherein said top surface intersects said leading face to define a front cutting edge and said top surface intersects said trailing face to define a trailing edge and said distal end surface intersects said top surface, said bottom surface, said leading face and said trailing face to define a distal outer edge.

13. The rotary drill bit as set forth in claim 12 wherein said front surface and said back relief surface intersect to form a clearance edge, said clearance edge extending radially from approximately a central portion of said insert to said distal outer edge between said trailing edge and said cutting edge.

14. The rotary drill bit insert as set forth in claim 13 wherein said back relief surface is rounded along the radial length thereof from said clearance edge to said trailing edge to form a concave back relief surface.

15. The rotary drill bit insert as set forth in claim 13 wherein said back relief surface is planar.

16. The rotary drill bit insert as set forth in claim 13 wherein said distal end surface is inclined rearwardly and inwardly toward said trailing face.

17. A rotary drill bit comprising a cylindrical body including two opposing dust collection openings and a top working surface having attached thereto an insert (18), said insert (18) including an elongated body rotatable about a central axis (22) and having two halves (20, 21) symmetrical about the axis (22), each symmetrical half having a top surface (24) including a planar front surface (42) contiguous and noncoplanar with a back relief surface (44), a bottom surface (26) opposite said top surface (24), a leading face (28) extending between forwardly facing edges of said front surface (42) and of said bottom surface (26), a trailing face (30) opposite said leading face (28) extending between rearwardly facing edges of said back relief surface (44) and of said bottom surface (26) and a distal end surface (32) extending between outwardly distal edges of said top surface (24), leading face (28), trailing face (30), and bottom surface (26), said front surface (42) inclined with radial distance at a constant angle of inclination with respect to a first radial line (48) projecting from said central axis (22) and inclined downwardly and rearwardly from said forwardly facing edge of said front surface (42) and inclined at a constant angle of inclination with respect to a second line (50) normal to said radial line (48) and to said central axis (22).

18. The rotary drill bit insert as set forth in claim 17 wherein said front surface is inclined with radial distance from said central axis at a constant angle of inclination with respect to a first radial line projecting from said central axis and inclined at a constant angle of inclination with respect to a second line normal to said radial line and said back relief surface is inclined with radial distance from said central axis at a variable angle of inclination with respect to said second line.

19. The rotary drill bit as set forth in claim 18 wherein said top surface intersects said leading face to define a front cutting edge and said top surface intersects said trailing face to define a trailing edge and said distal end surface intersects said top surface, said bottom surface, said leading face and said trailing face to define a distal outer edge and said front surface and said back relief surface intersect to form a clearance edge, said clearance edge extending radially from approximately a central portion of said insert to said distal outer edge between said trailing edge and said cutting edge, wherein said back relief surface is rounded along the radial length thereof from said clearance edge to said trailing edge to form a concave back relief surface.

20. A method of drilling a hole in a work surface comprising the steps of positioning a mine tool including a rotary drill bit including a rotary drill bit insert (18) having an elongated body rotatable about a central axis (22) and having two halves (20, 21) symmetrical about the axis (22), each symmetrical half having a top surface (24) including a planar front surface (42) contiguous and noncoplanar with a back relief surface (44), a bottom surface (26) opposite said top surface (24), a leading face (28) extending between forwardly facing edges of said front surface (42) and of said bottom surface (26), a trailing face (30) opposite said leading face (28) extending between rearwardly facing edges of said back relief surface (44) and of said bottom surface (26) and a distal end surface (32) extending between outwardly distal edges of said top surface (24), leading face (28), trailing face (30), and bottom surface (26), said front surface (42) inclined with radial distance at a constant angle of inclination with respect to a first radial line (48) projecting from said central axis (22) and inclined downwardly and rearwardly from said forwardly facing edge of said front surface (42) and inclined at a constant angle of inclination with respect to a second line (50) normal to said radial line (48) and to said central axis (22); and rotating the rotary drill bit insert (18) at about 250–600 rpm and about 1000–10,000 lbs, thrust for a time sufficient to drill the hole in the work surface.

* * * * *